US009817328B2

(12) United States Patent
Miura et al.

(10) Patent No.: US 9,817,328 B2
(45) Date of Patent: Nov. 14, 2017

(54) CHARGING MEMBER, PROCESS CARTRIDGE, AND IMAGE FORMING APPARATUS

(71) Applicant: FUJI XEROX CO., LTD., Tokyo (JP)

(72) Inventors: Hiroyuki Miura, Kanagawa (JP); Kosuke Narita, Kanagawa (JP); Yoshiyuki Hayashi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/218,264

(22) Filed: Jul. 25, 2016

(65) Prior Publication Data

US 2017/0277059 A1 Sep. 28, 2017

(30) Foreign Application Priority Data

Mar. 22, 2016 (JP) ..... 2016-057370
Mar. 22, 2016 (JP) ..... 2016-057371
Mar. 22, 2016 (JP) ..... 2016-057372

(51) Int. Cl.
*G03G 15/02* (2006.01)
*G03G 21/18* (2006.01)

(52) U.S. Cl.
CPC ..... *G03G 15/0233* (2013.01); *G03G 21/18* (2013.01); *G03G 21/1814* (2013.01)

(58) Field of Classification Search
CPC . G03G 15/0233; G03G 21/18; G03G 21/1814
See application file for complete search history.

(56) References Cited

U.S. PATENT DOCUMENTS 6,684,043 B1 * 1/2004 Zona ..... G03G 15/0233 399/176
2007/0189790 A1 * 8/2007 Miura ..... G03G 15/0233 399/50
2010/0135695 A1 * 6/2010 Mayuzumi ..... G03G 15/0233 399/111

(Continued)

FOREIGN PATENT DOCUMENTS

JP 2007-225995 A 9/2007
JP 2012-118449 A 6/2012
JP 2015-45788 A 3/2015

OTHER PUBLICATIONS

Translation of reference Tatsumi et al. (JP 2015-045,788 A) Pub date Mar. 12, 2015 Listed in IDS and translation provided by Applicant.*

*Primary Examiner* — Rodney Bonnette
(74) *Attorney, Agent, or Firm* — Sughrue Mion, PLLC

(57) ABSTRACT

A charging member includes a support member, a conductive elastic layer disposed on the support member, and a front surface layer disposed on the conductive elastic layer. Irregularities with a cycle of shorter than 0.1 mm and irregularities with a cycle of 0.1 mm or longer are distributed on an entirety of an outer circumferential surface of the charging member, and satisfy the following conditions of (1) and (2): (1) the irregularities with the cycle of shorter than 0.1 mm have an average height of greater than 0 μm and 4 μm or less; and (2) the irregularities with the cycle of 0.1 mm or longer have an average height of from 5 μm to 30 μm. A half-value width of a maximum frequency value of height distribution on the outer circumferential surface is from 1 μm to 3 μm.

13 Claims, 5 Drawing Sheets

(56) References Cited

U.S. PATENT DOCUMENTS

| | | | | |
|---|---|---|---|---|
| 2014/0219680 | A1* | 8/2014 | Hagiwara | G03G 15/0233 399/159 |
| 2016/0154336 | A1* | 6/2016 | Masu | G03G 15/0233 399/176 |

* cited by examiner

CHARGING MEMBER, PROCESS CARTRIDGE, AND IMAGE FORMING APPARATUS

CROSS-REFERENCE TO RELATED APPLICATIONS

This application is based on and claims priority under 35 USC 119 from Japanese Patent Applications No. 2016-057370 filed Mar. 22, 2016, No. 2016-057371 filed Mar. 22, 2016, and No. 2016-057372 filed Mar. 22, 2016.

BACKGROUND

Technical Field

The present invention relates to a charging member, a process cartridge, and an image forming apparatus.

SUMMARY

According to an aspect of the invention, a charging member includes:

a support member;

a conductive elastic layer disposed on the support member; and a front surface layer disposed on the conductive elastic layer. Irregularities with a cycle of shorter than 0.1 mm and irregularities with a cycle of 0.1 mm or longer are distributed on an entirety of an outer circumferential surface of the charging member, and satisfy the following conditions of (1) and (2):

(1) The irregularities with the cycle of shorter than 0.1 mm have an average height of greater than 0 μm and 4 μm or less; and (2) The irregularities with the cycle of 0.1 mm or longer have an average height of from 5 μm to 30 μm.

A half-value width of a maximum frequency value of height distribution on the outer circumferential surface is from 1 μm to 3 μm.

BRIEF DESCRIPTION OF THE DRAWINGS

Exemplary embodiments of the present invention will be described in detail based on the following figures, wherein.

DETAILED DESCRIPTION

Hereinafter, exemplary embodiments of the invention will be described. Description and Example thereof are provided as an example of the exemplary embodiment, and thus a range of the invention is not limited thereto.

In the specification, an "electrophotographic photoreceptor" is also simply referred to as a "photoreceptor".

In the specification, a "micro-chromatic line" indicates an unintended image that appears on a halftone image, that is, a linear image that extends in a direction orthogonal to a transport direction of a recording medium and that has a length in millimeter order.

Charging Member

A charging member according to the exemplary embodiment includes a support member, a conductive elastic layer disposed on the support member, and a front surface layer disposed on the conductive elastic layer. In other words, the charging member according to the exemplary embodiment includes at least the conductive elastic layer and the front surface layer which are laminated on the support member.

Then, irregularities with a cycle of shorter than 0.1 mm and irregularities with a cycle of 0.1 mm or longer, are distributed on the entirety of the outer circumferential surface of the charging member according to the exemplary embodiment. Also, the charging member according to the exemplary embodiment satisfies the following conditions of (1) and (2). A half-value width of the mode of the height distribution on the outer circumferential surface is in a range of from 1 μm to 3 μm.

(1) The irregularities with the cycle of shorter than 0.1 mm have an average height of greater than 0 μm and 4 μm or less.

(2) The irregularities with the cycle of 0.1 mm or longer have an average height of from 5 μm to 30 μm.

There is no particular limitation to a shape of the charging member according to the exemplary embodiment. For example, examples of the shape of the charging member according to the exemplary embodiment include a roll shape shown in FIG. 1, and a belt shape.

Hereinafter, a configuration of the charging member according to the exemplary embodiment and geometric quantities of the outer circumferential surface of the charging member will be described with reference to the figures.

Figure 1:
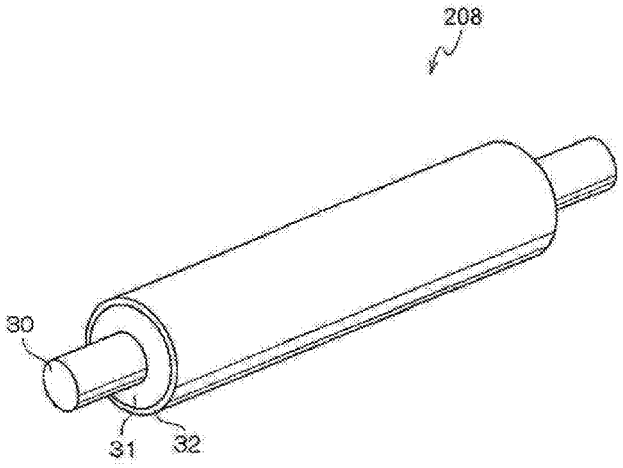
FIG. 1 is a view of a schematic configuration showing an example of a charging member according to an exemplary embodiment.

FIG. 1 is a view showing an example of the charging member according to the exemplary embodiment. A charging member 208 shown in FIG. 1 includes a support member 30 which is a bar-shaped member (shaft) having a cylindrical shape or a column shape, a conductive elastic layer 31 disposed on an outer circumferential surface of the support member 30, and a front surface layer 32 disposed on an outer circumferential surface of the conductive elastic layer 31.

Figure 2A:
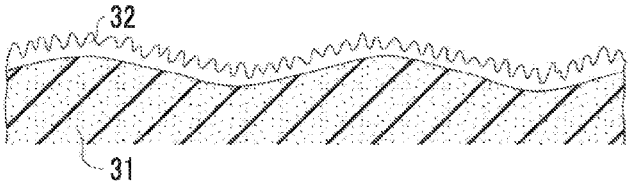
FIG. 2A is a view schematically showing an example of irregularities which are distributed on an outer circumferential surface of the charging member according to the exemplary embodiment.

FIG. 2A is a view schematically showing an example of irregularities which are distributed on the outer circumferential surface of the charging member according to the exemplary embodiment. FIG. 2A shows a shape viewed when the front surface layer 32 and the conductive elastic layer 31 of the charging member 208 are cut in a thickness direction and in an axial direction of the support member 30. The outer circumferential surface of the charging member 208 is shaped by the front surface layer 32 disposed on undulation formed on the conductive elastic layer 31.

In the exemplary embodiment, a surface texture of the outer circumferential surface of the charging member is measured using a confocal laser microscope. As measurement conditions, a measurement cycle in a rotating direction (referred to as an "X direction") of the charging member is 0.05 μm, a measurement cycle in a direction (referred to as an "Y direction") orthogonal to the rotating direction of the charging member is 0.05 μm, a measurement range in X and Y directions is at least 400 μm by 600 μm, and a measurement range in a height directions (Z direction) is 50 μm. Then, when the charging member has the roll shape, measurement data is subjected to surface correction with curvature of a roll and noise correction in which an abnormal value is removed, and the geometric quantities of the outer circumferential surface of the charging member is obtained from the corrected correction data. Detailed description thereof is provided in the Example section.

Figure 2B:
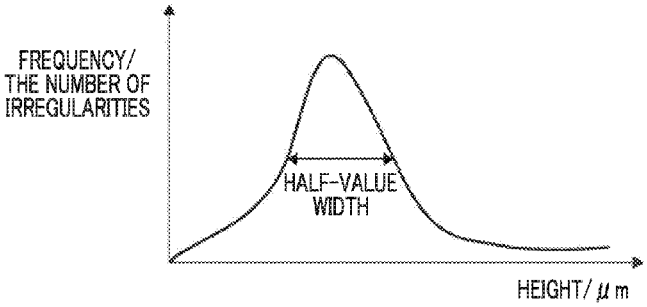
FIG. 2B shows an example of an approximate curve for obtaining a "half-value width of the maximum frequency value of height distribution on the outer circumferential surface"

The "half-value width of the maximum frequency value of the height distribution on the outer circumferential surface" is obtained as the half-value width (entire width at a half value), with the lowest measurement point in the corrected data as a reference (zero in height), by creating a histogram in the height of all of the measurement points in the X and Y directions and approximation of the histogram to a curve. FIG. 2B shows an example of an approximate curve for obtaining the half-value width.

An average height of the "irregularities with the cycle of shorter than 0.1 mm" and an average height of the "irregularities with the cycle of 0.1 mm or longer" are obtained by drawing a profile curve (that is, a curve formed by connecting heights in the measurement cycle of 0.05 μm, and referred to as a "Y-directional profile curve") in the Y direction in the correction data and by analyzing the Y-directional profile curve. The cycle of the irregularities means a length between peaks of two adjacent convex portions.

The height of the "irregularities with the cycle of shorter than 0.1 mm" is obtained by removing a long-wavelength component using a wavelength of 0.1 mm as a cutoff value and creating a "roughness profile". Heights of all convex portions on one "roughness profile" created from one Y-directional profile curve are measured. Here, a height of a convex portion means a height from the bottom of a concave portion which is the lower of the bottoms of concave portions positioned on the right and left sides of the convex portion to the vertex of the convex portion. Then, an average of heights of all convex portions on one "roughness profile" is obtained, further, an average of all "roughness profiles" in the X direction is obtained, and then the average value thereof is an average height of the "irregularities with the cycle of shorter than 0.1 mm".

The height of the "irregularities with the cycle of 0.1 mm or longer" is obtained by removing a short-wavelength component using the wavelength of 0.1 mm as a cutoff value and creating a "waviness profile". Heights of all of the convex portions on one "waviness profile" created from one Y-directional profile curve are measured. Here, a height of a convex portion means a height from the bottom of a concave portion which is the lower of the bottoms of a concave portion positioned on the right and left sides of the convex portion, to the convex portion. Then, an average of heights of all convex portions on one "waviness profile" is obtained, further, an average of all "waviness profiles" in the X direction is obtained, and then the average value thereof is an average height of the "irregularities with the cycle of 0.1 mm or longer".

In the specification, the "irregularities with the cycle of shorter than 0.1 mm" is also referred to as a "roughness component", and the "irregularities with the cycle of 0.1 mm or longer" is also referred to as a "waviness component".

The image forming apparatus employs a charging method in which only a DC voltage is applied to the charging member, or a charging method in which a voltage obtained by superimposing an AC voltage to a DC voltage is applied to the charging member. In a case where only the DC voltage is applied to the charging member and the photoreceptor is charged in a contact charging method, an unintended micro-chromatic line is produced on an image in some cases. Meanwhile, in a case where the voltage obtained by superimposing the AC voltage to the DC voltage is applied to the charging member and the photoreceptor is charged by a contact charging method, an unintended white spot is produced on an image in some cases. The charging member of the exemplary embodiment reduces production of both the micro-chromatic line and the white spot. As a mechanism for less production thereof, the following description is assumed.

Hereinafter, a micro-chromatic line produced when the photoreceptor is subjected to contact charging by the charging member, to which only the DC voltage is applied, is simply referred to as the micro-chromatic line. A white spot produced when the photoreceptor is subjected to contact charging by the charging member, to which the voltage obtained by superimposing the AC voltage to the DC voltage is applied, is simply referred to as the white spot.

It is considered that the micro-chromatic line is produced due to a low discharge frequency of discharge phenomena (post-discharge) that occurs immediately after a contact between the photoreceptor and the charging member. In the case where only the DC voltage is applied, it is considered that the discharge frequency of the post-discharge is low, and regions which are not sufficiently charged are irregularly formed on the outer circumferential surface of the charging member. As a result, the micro-chromatic line is likely to be produced, compared to the case where the AC voltage is superimposed to the DC voltage. When the charging member is continuously used, toner or the like is accumulated on the outer circumferential surface of the charging member. Thus, it is considered that when the charging member is used continuously, the toner or the like is accumulated on the outer circumferential surface of the charging member, and therefore, the discharge frequency of the post-discharge is further lowered and the micro-chromatic line is more clearly viewed.

Meanwhile, it is considered that the white spot is produced due to locally strong discharge which is likely to occur when the AC voltage is superimposed to the DC voltage.

The micro-chromatic line and the white spot are both likely to be produced and more clearly viewed in a case where an image is formed at a higher speed and in a case where an image is formed using toner having a smaller particle diameter.

In order to reduce the production of the micro-chromatic line, it is effective that the irregularities are distributed on the outer circumferential surface of the charging member, thereby increasing a discharge space between the photoreceptor and the charging member and promoting the post-discharge. However, only the distribution of the irregularities on the outer circumferential surface of the charging member does not result in effective reduction in the production of the micro-chromatic line, and does not result in reduction in the occurrence of the locally strong discharge and reduction in the production of the white spot, either.

According to the charging member of the exemplary embodiment, while the mechanism is not entirely clear, it is considered that the "irregularities with the cycle of shorter than 0.1 mm" (roughness components) and the "irregularities with the cycle of 0.1 mm or longer" (waviness components) are distributed on the outer circumferential surface of the charging member so as to have the average heights of greater than 0 μm and 4 μm or less and of from 5 μm to 30 μm, respectively, and both types of irregularities are arranged, thereby promoting the post-discharge when only the DC voltage is applied, reducing the occurrence of the locally strong discharge when the AC voltage is superimposed to the DC voltage, and then causing the toner or the like to be unlikely to be attached to the outer circumferential surface, and, as a result, reducing the production of the micro-chromatic line and the production of the white spot.

The average height of the roughness components is preferably greater than 0 μm and 4 μm or less, more preferably from 0.5 μm to 3.5 μm, and still more preferably from 1.0 μm to 3.0 μm.

The average height of the waviness components is preferably from 5 μm to 30 μm, more preferably from 5 μm to 20 μm, and still more preferably from 6 μm to 10 μm.

In the exemplary embodiment, the "half-value width of the maximum frequency value of the height distribution on the outer circumferential surface" is from 1 μm to 3 μm. The half-value width of wider than 3 μm means variations in the height of the irregularities on the outer circumferential surface. In this case, it is difficult to reduce both the micro-chromatic line and the white spot. It is considered that it is more desirable as the half-value width is narrower in terms of low variations in the height of the irregularities on the outer circumferential surface. However, when the half-value width is decreased to be narrower than 1 μm, the heights of the irregularities, which are distributed on the outer circumferential surface, are lowered, the outer circumferential surface becomes close to an even surface, and it is difficult to reduce the micro-chromatic line and the white spot. In addition, it is difficult to have the half-value width of narrower than 1 μm, while the conductive elastic layer is manufactured by extrusion molding which is suitable for mass production.

A mean cycle of the "irregularities with the cycle of shorter than 0.1 mm" (roughness components) which are distributed on the outer circumferential surface of the charging member is preferably longer than 2 μm, more preferably longer than 3 μm, and still more preferably longer than 5 μm, and is preferably 50 μm or shorter, more preferably 20 μm or shorter, and still more preferably 15 μm or shorter.

A mean cycle of the "irregularities with the cycle of 0.1 mm or longer" (waviness components) which are distributed on the outer circumferential surface of the charging member is preferably 0.15 mm or longer, more preferably 0.20 mm or longer, and still more preferably 0.25 mm or longer, and is preferably 0.45 mm or shorter, more preferably 0.35 mm or shorter, and still more preferably 0.30 mm or shorter.

A control method of the heights and the cycles of the roughness components and the waviness components which are distributed on the outer circumferential surface of the charging member will be described below.

Next, each configurational element of the charging member according to the exemplary embodiment will be described.

Support Member

The support member is a conductive member that functions as an electrode and a support of the charging member. The support member may be a hollow member (cylindrical member) or may be a non-hollow member.

Examples of the support member include a metal member formed of iron (free-machining steel or the like), copper, brass, stainless steel, aluminum, nickel, or the like; a iron member subjected to coating processing using chrome, nickel, or the like; a member subjected to plating processing on an outer circumferential surface of a resin or ceramic member; a resin or ceramic member which contains a conductive agent; or the like.

Conductive Elastic Layer

The conductive elastic layer is a layer disposed on the outer circumferential surface of the support member. The conductive elastic layer may be directly disposed on the outer circumferential surface of the support member or may be disposed on the outer circumferential surface of the support member with an adhesive layer interposed therebetween.

The conductive elastic layer may be a single layer or may be a laminated body in which plural layers are laminated. The conductive elastic layer may be a foamed conductive elastic layer, may be a non-foamed conductive elastic layer, or may also be formed by laminating the foamed conductive elastic layer and the non-foamed conductive elastic layer.

An exemplary embodiment of the conductive elastic layer contains an elastic material, a conductive agent, and other additives.

Examples of the elastic material include, for example, polyurethane, nitrile rubber, isoprene rubber, butadiene rubber, ethylene-propylene rubber, ethylene-propylene-diene rubber, epichlorohydrin rubber, epichlorohydrin-ethylene oxide rubber, epichlorohydrin-ethylene oxide-allyl glycidyl ether rubber, styrene-butadiene rubber, acrylonitrile-butadiene rubber, chloroprene rubber, chlorinated polyisoprene, hydrogenated polybutadiene, butyl rubber, silicone rubber, fluororubber, natural rubber, and an elastic material obtained by mixing the above substances. Of the elastic materials, it is preferable to use polyurethane, silicone rubber, nitrile rubber, epichlorohydrin rubber, epichlorohydrin-ethylene oxide rubber, epichlorohydrin-ethylene oxide-allyl glycidyl ether rubber, ethylene-propylene-diene rubber, acrylonitrile-butadiene rubber, and an elastic material obtained by mixing the above substances.

Examples of the conductive agent include an electronically conductive agent and an ion conductive agent. Examples of the electronically conductive agent include powder of carbon black such as furnace black, thermal black, channel black, ketjen black, acetylene black, color black; pyrolytic carbon; graphite; various metals or alloys such as aluminum, copper, nickel, stainless steel; various metal oxides such as a tin oxide, an indium oxide, a titanium oxide, a tin oxide-antimony oxide solid solution, a tin oxide-indium oxide solid solution; a substance subjected to conductive processing on a surface of an insulating material; or the like. Examples of the ion conductive agent include perchlorate or chlorate such as tetraethylammonium, lauryltrimethylammonium, benzyltrialkylammonium; alkali metal or alkali earth metal perchlorate or chlorate such as lithium or magnesium. As the conductive agent, one type thereof may be individually used, or a combination of two or more types thereof may be used.

It is desirable that volume resistivity of the conductive elastic layer is from $10^3$ Ωcm to $10^{14}$ Ωcm. An electronically conductive agent content in the conductive elastic layer is preferably from 1 part by weight to 30 parts by weight, and more preferably from 15 parts by weight to 25 parts by weight, with respect to 100 parts by weight of the elastic material. An ion conductive agent content in the conductive elastic layer is preferably from 0.1 parts by weight to 5 parts by weight, and more preferably from 0.5 parts by weight to 3 parts by weight, with respect to 100 parts by weight of the elastic material.

Examples of the other compounded additives in the conductive elastic layer include, for example, a softener, a plasticizing agent, a hardener, a vulcanizing agent, a vulcanization accelerator, a vulcanization accelerator aid, an antioxidant, a surfactant, a coupling agent, and a filler.

Examples of the vulcanization accelerator include thiazole series, thiram, sulfenamide, thiourea, dithiocarbamate series, guanidine series, aldehyde-ammonia series, and the like. As the vulcanization accelerator, one type thereof may be individually used, or a combination of two or more types thereof may be used.

A vulcanization accelerator content in the conductive elastic layer is preferably from 1 part by weight to 10 parts by weight, and more preferably from 2 parts by weight to 6 parts by weight, with respect to 100 parts by weight of the elastic material.

Examples of the vulcanization accelerator aid include a zinc oxide, stearic acid, and the like. As the vulcanization accelerator aid, one type thereof may be individually used, or a combination of two or more types thereof may be used.

A vulcanization accelerator aid content in the conductive elastic layer is preferably from 1 part by weight to 15 parts by weight, and more preferably from 3 parts by weight to 10 parts by weight, with respect to 100 parts by weight of the elastic material.

Examples of the filler contained in the conductive elastic layer include calcium carbonate, silica, clay mineral, and the like. As the filler, one type thereof may be individually used, or a combination of two or more types thereof may be used.

A filler content in the conductive elastic layer is preferably from 5 parts by weight to 100 parts by weight, and more preferably from 10 parts by weight to 60 parts by weight, with respect to 100 parts by weight of the elastic material.

A granulated substance (the conductive agent such as carbon black, the vulcanization accelerator aid such as a zinc oxide, the filler such as calcium carbonate, or the like) contained in the conductive elastic layer has a particle diameter of preferably at most 10 μm or smaller and a particle diameter of more preferably 2 μm or smaller, and has a particle diameter of preferably at least 20 nm or larger and a particle diameter of more preferably 50 nm or larger. The particle diameter of the granulated substance contained in the conductive elastic layer is obtained by observing a cross section of the conductive elastic layer using an optical microscope.

The layer thickness of the conductive elastic layer is preferably from 1 mm to 10 mm, more preferably from 2 mm to 8 mm, and still more preferably from 3 mm to 6 mm. The layer thickness of the conductive elastic layer is a value obtained by observing a cross section of the charging member cut in a direction orthogonal to the rotating direction using an optical microscope and by measuring random ten points and obtaining an average value.

An example of the adhesive layer interposed between the conductive elastic layer and the support member is a resin layer, specifically, a resin layer formed of a polyolefin, an acrylic resin, an epoxy resin, polyurethane, nitrile rubber, chlorine rubber, a vinyl chloride resin, a vinyl acetate resin, polyester, a phenolic resin, a silicone resin, or the like. The adhesive layer may contain the conductive agent (for example, the electronically conductive agent or the ion conductive agent described above).

Examples of a method of forming the conductive elastic layer on the support member include, for example, a method in which both the bar-shaped support member and a conductive elastic layer forming composition obtained by mixing the elastic material, the conductive agent, and another additive, are extruded from an extruder, a layer of the conductive elastic layer forming composition is formed on the outer circumferential surface of the support member, and then the layer of the conductive elastic layer forming composition is heated to be subjected to cross-linking reaction such that the conductive elastic layer is formed; and a method in which a conductive elastic layer forming composition obtained by mixing the elastic material, the conductive agent, and another additive, is extruded from an extruder to the outer circumferential surface of the support member having an endless belt shape, a layer of the conductive elastic layer forming composition is formed on the outer circumferential surface of the support member, and then the layer of the conductive elastic layer forming composition is heated to be subjected to cross-linking reaction such that the conductive elastic layer is formed. The support member may have an adhesive layer on the outer circumferential surface thereof.

It is desirable that the "irregularities with the cycle of 0.1 mm or longer" (waviness components) which are distributed on the outer circumferential surface of the charging member are the irregularities originating mainly from the conductive elastic layer. When wave undulation is formed on the outer circumferential surface of the charging member and the wave undulation originates from the conductive elastic layer, the wave undulation indicates elasticity when the charging member contacts with the photoreceptor, a nip with the photoreceptor is well formed such that the property of being driven by the photoreceptor is readily achieved, and good high-speed applicability is obtained.

An average height of the "irregularities with the cycle of 0.1 mm or longer" (waviness components) which are distributed on the outer circumferential surface of the conductive elastic layer is preferably from 5 μm to 30 μm. In addition, a mean cycle of the waviness components on the outer circumferential surface of the conductive elastic layer, that is, a mean cycle of the "irregularities with the cycle of 0.1 mm or longer" (waviness components) distributed on the outer circumferential surface of the conductive elastic layer, is preferably 0.15 mm or longer, more preferably, 0.20 mm or longer, and still more preferably 0.25 mm or longer, and is preferably 0.45 mm or shorter, more preferably, 0.35 mm or shorter, and still more preferably 0.30 mm or shorter.

The height and the cycle of the waviness components on the outer circumferential surface of the conductive elastic layer, and the height and the cycle of the waviness components on the outer circumferential surface of the charging member are controlled, for example, by the following (i) to (iii).

(i) An amount of the vulcanization accelerator or the vulcanization accelerator aid which is contained in the conductive elastic layer forming composition: as the amount of the vulcanization accelerator or the vulcanization accelerator aid is increased, the waviness components tend to be increased.

(ii) A die temperature obtained when the conductive elastic layer forming composition is extruded from the extruder: as the die temperature is higher, the waviness components tend to become decreased. It is preferable that the die temperature is in a range of from 40° C. to 90° C.

(iii) As the heating temperature and a period of heating time obtained when the conductive elastic layer forming composition is heated to be subjected to the cross-linking reaction: as the heating temperature is increased, the waviness components tend to be decreased. As the period of heating time is increased, the waviness components tend to be decreased. When a furnace is used for heating, the heating temperature is preferably in a range of from 120° C. to 180° C., and the period of heating time is preferably in a range of from 20 minutes to 90 minutes.

Front Surface Layer

For example, the front surface layer is provided so as to reduce contamination of the charging member by the toner or the like.

An exemplary embodiment of the front surface layer includes a binder resin, particles, and another additive. It is desirable that the particles contained in the front surface layer are disposed in the binder resin.

Examples of the binder resin of the front surface layer include polyamide, polyimide, polyester, polyethylene, polyurethane, a phenolic resin, a silicone resin, an acrylic resin, a melamine resin, an epoxy resin, polyvinylidene fluoride, a tetrafluoroethylene copolymer, a polyvinyl butyral, ethylene-tetrafluoroethylene copolymer, fluororubber, polycarbonate, polyvinyl alcohol, polyvinylidene chloride, polyvinyl chloride, an ethylene-vinyl acetate copolymer, cellulose, and the like. As the binder resin, one type thereof may be individually used, or a combination of two or more types thereof may be used.

An example of particles contained in the front surface layer is a conductive agent. It is desirable that conductive particles having an average particle diameter of 3 μm or smaller and volume resistivity of $10^9$ Ωcm or less as the conductive agent contained in the front surface layer. Examples of the conductive particles include a metal oxide such as a tin oxide, a titanium oxide, or a zinc oxide; carbon black; and the like. As the conductive particles, it is preferable to use the tin oxide in terms of reduction in the production of the micro-chromatic line, and it is preferable to use the tin oxide individually, or to use both the tin oxide and the carbon black.

A conductive agent content in the front surface layer is preferably from 10 parts by weight to 90 parts by weight, and more preferably from 40 parts by weight to 70 parts by weight, with respect to 100 parts by weight of the binder resin.

The front surface layer may contain particles other than the conductive agent particles in order to control the shape of the front surface of the charging member. Examples of the particles include polyamide particles, fluororesin particles, silicone resin particles, and the like, and it is preferable to use polyamide particles in terms of reduction in the production of the micro-chromatic line. As the particles, one type thereof may be individually used, or a combination of two or more types thereof may be used.

A particle content in the front surface layer is preferably from 1 part by weight to 20 parts by weight, and more preferably from 2 parts by weight to 10 parts by weight, with respect to 100 parts by weight of the binder resin.

A particle diameter of a granulated substance (conductive agent, polyamide particles, or the like) contained in the front surface layer is preferably at most 10 μm or smaller and more preferably 7 μm or smaller, and preferably at least 1 μm or larger and more preferably 3 μm or larger. The particle diameter of the granulated substance contained in the front surface layer is obtained by observing a cross section of the front surface layer using an optical microscope.

An example of a method of forming the front surface layer on the conductive elastic layer is, for example, a method in which a front surface layer forming composition obtained by mixing a binder resin, particles, and another additive is applied on the conductive elastic layer, a layer of the front surface layer forming composition is formed, and then the layer of the front surface layer forming composition is dried. Examples of a method of applying the front surface layer forming composition on the conductive elastic layer include, for example, dip coating, roll coating, blade coating, wire bar coating, spraying, bead coating, air knife coating, and curtain coating.

The layer thickness of the front surface layer is preferably from 3 μm to 20 μm, and more preferably from 5 μm to 15 μm. The layer thickness of the front surface layer is a value obtained by observing a cross section of the charging member cut in a direction orthogonal to the rotating direction using an optical microscope and by measuring random hundred points and obtaining an average value.

It is desirable that the "irregularities with the cycle of shorter than 0.1 mm" (roughness components) which are distributed on the outer circumferential surface of the charging member are the irregularities originating from the front surface layer. The highly uniform roughness components can be distributed in a method in which the "irregularities with the cycle of shorter than 0.1 mm" are formed on the front surface layer and, then, the roughness components are distributed on the outer circumferential surface of the charging member, rather than in a method in which the "irregularities with the cycle of shorter than 0.1 mm" are formed on the conductive elastic layer and, then, the roughness components are distributed on the outer circumferential surface of the charging member.

An average height of the "irregularities with the cycle of shorter than 0.1 mm" (roughness components) which are distributed on the outer circumferential surface of the front surface layer is preferably greater than 0 μm and 4 μm or less. In addition, a mean cycle of the roughness components on the outer circumferential surface of the front surface layer is preferably 2 μm or longer, more preferably, 3 μm or longer, and still more preferably 5 μm or longer, and is preferably 50 μm or shorter, more preferably, 20 μm or shorter, and still more preferably 15 μm or shorter.

The height and the cycle of the roughness components on the outer circumferential surface of the front surface layer, and the height and the cycle of the roughness components on the outer circumferential surface of the charging member are controlled, for example, with the particle diameter and the amount of the granulated substance contained in the front surface layer forming composition. It is desirable that the irregularities are formed, on the front surface of the front surface layer, of the granulated substance or an aggregation substance of the granulated substance contained in the front surface layer forming composition.

Charging Device, Image Forming Apparatus, and Process Cartridge

A charging device is a charging device that includes the charging member according to the exemplary embodiment, and that charges the front surface of the photoreceptor by a contact charging method. The charging device is a charging device which applies only the DC voltage to the charging member or a charging device which applies the voltage obtained by superimposing the AC voltage to the DC voltage.

An image forming apparatus according to the exemplary embodiment includes the photoreceptor, the charging device, a latent image forming device that forms a latent image on the front surface of the charged photoreceptor, a developing device that develops the latent image formed on the front surface of the photoreceptor by using developer containing toner, and that forms a toner image on the front surface of the photoreceptor, and a transfer device that transfers the toner image formed on the front surface of the photoreceptor to a recording medium. The image forming apparatus according to exemplary embodiment may further include at least one device selected from a fixing device that fixes the toner image to the recording medium; a cleaning device that cleans the front surface of the photoreceptor after the transfer of the toner image and before the charging; or a neutralization device that irradiates the front surface of the photoreceptor with light and neutralizes the charge on the front surface of the photoreceptor after the transfer of the toner image and before the charging.

The image forming apparatus according to the exemplary embodiment may be any one of a direct transfer type apparatus in which the toner image formed on the front surface of the photoreceptor is directly transferred to the recording medium, or an intermediate transfer type apparatus in which the toner image formed on the front surface of the photoreceptor is primarily transferred to a front surface of an intermediate transfer body, and then the toner image transferred to the front surface of the intermediate transfer body is secondarily transferred to a front surface of the recording medium.

A process cartridge according to the exemplary embodiment is a cartridge that is attached to and detached from the image forming apparatus and includes at least the photoreceptor and the charging device according to the exemplary embodiment. The process cartridge according to the exemplary embodiment may further include at least one device selected from the developing device, the cleaning device of the photoreceptor, the neutralization device of the photoreceptor, the transfer device, or the like.

Hereinafter, configurations of the charging device, the image forming apparatus, and the process cartridge according to the exemplary embodiment will be described with reference to the figures.

Figure 3:
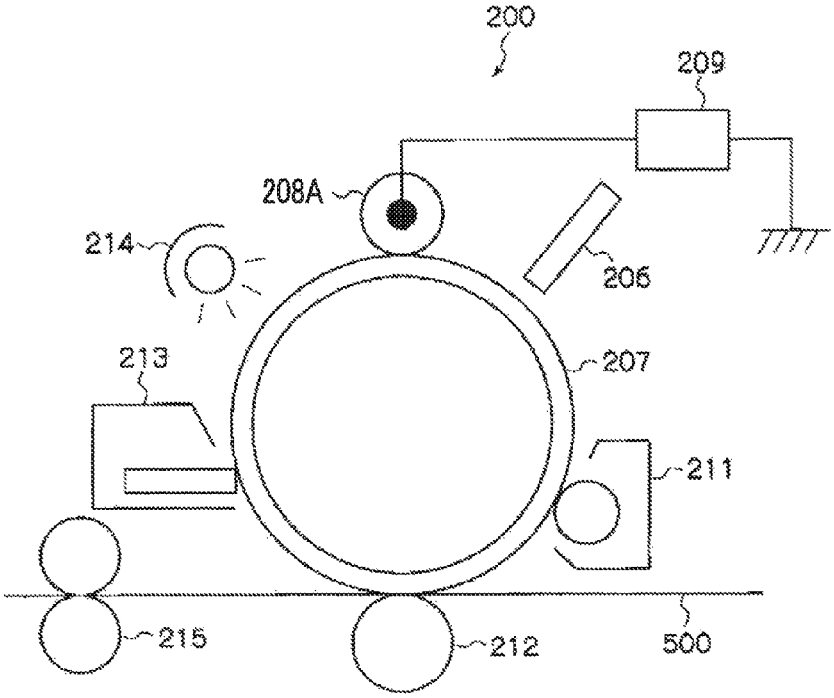
FIG. 3 is a view of a schematic configuration showing an example of an image forming apparatus according to an exemplary embodiment.
Figure 4:
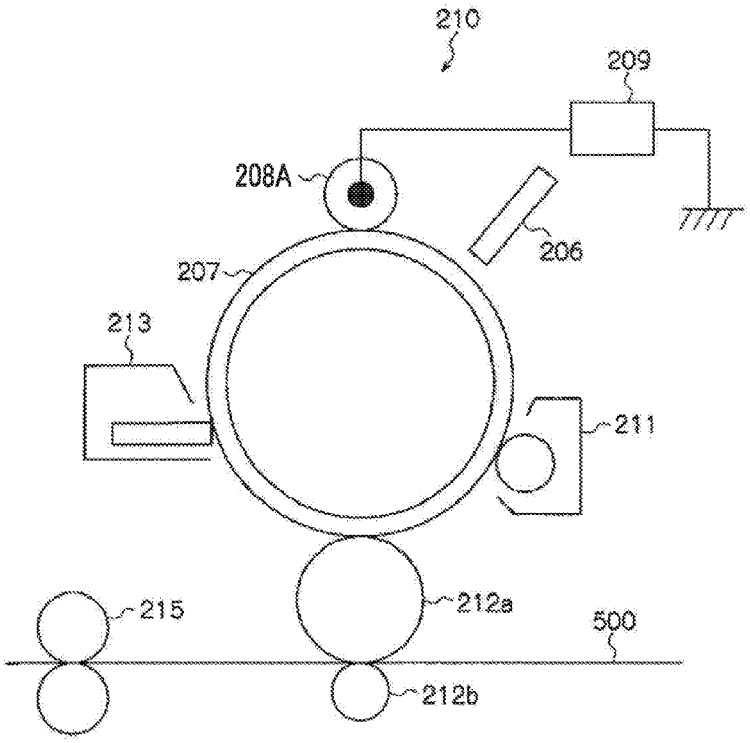
FIG. 4 is a view of a schematic configuration showing an example of another image forming apparatus according to another exemplary embodiment.

FIG. 3 is a view schematically showing the direct transfer type image forming apparatus as an example of the image forming apparatus according to the exemplary embodiment. FIG. 4 is a view schematically showing the intermediate transfer type image forming apparatus as an example of the image forming apparatus according to the exemplary embodiment.

An image forming apparatus 200 shown in FIG. 3 includes a photoreceptor 207, a charging device 208A that charges a front surface of the photoreceptor 207, a power supply 209 connected to the charging device 208A, an exposure device 206 that exposes the front surface of the photoreceptor 207 and forms a latent image, a developing device 211 that develops the latent image on the photoreceptor 207 by using developer containing toner, a transfer device 212 that transfers a toner image on the photoreceptor 207 to a recording medium 500, a fixing device 215 that fixes the toner image to the recording medium 500, a cleaning device 213 that removes toner remaining on the photoreceptor 207, and a neutralization device 214 that neutralizes the charge on the front surface of the photoreceptor 207.

An image forming apparatus 210 shown in FIG. 4 includes the photoreceptor 207, the charging device 208A, the power supply 209, the exposure device 206, the developing device 211, a primary transfer member 212*a* and a secondary transfer member 212*b* that transfer a toner image on the photoreceptor 207 to the recording medium 500, the fixing device 215, and the cleaning device 213. Similar to the image forming apparatus 200, the image forming apparatus 210 may include the neutralization device.

The charging device 208A is a contact charging type charging device that is formed by a roll-shaped charging member, that contacts with the front surface of the photoreceptor 207, and that charges the front surface of the photoreceptor 207. Only the DC voltage is applied or the voltage obtained by superimposing the AC voltage to the DC voltage is applied to the charging device 208A from the power supply 209.

An example of the exposure device 206 is an optical system device that includes a light source such as a semiconductor laser, or a light emitting diode (LED).

The developing device 211 is a device that supplies toner to the photoreceptor 207. The developing device 211 causes a roll-shaped developer holding member to come into contact or to approach the photoreceptor 207 and causes the toner to be attached to a latent image on the photoreceptor 207, thereby forming a toner image.

Examples of the transfer device 212 include, for example, a corona discharge generator, and a conductive roll that is pressed to the photoreceptor 207 with the recording medium. 500 interposed therebetween.

An example of the primary transfer member 212*a* is, for example, a conductive roll that contacts with the photoreceptor 207 and rotates. An example of the secondary transfer member 212*b* is, for example, a conductive roll that is pressed to the primary transfer member 212*a* with the recording medium 500 interposed therebetween.

An example of the fixing device 215 is a heating-fixing device that includes a heating roll and a pressure roll that is pressed to the heating roll.

An example of the cleaning device 213 is a device that includes a blade, a brush, a roll, or the like, as a cleaning member. Examples of a material of a cleaning blade include urethane rubber, neoprene rubber, silicone rubber, and the like.

The neutralization device 214 is, for example, a device that irradiates the front surface of the photoreceptor 207 with light after the transfer and that neutralizes residual potential of the photoreceptor 207.

Figure 5:
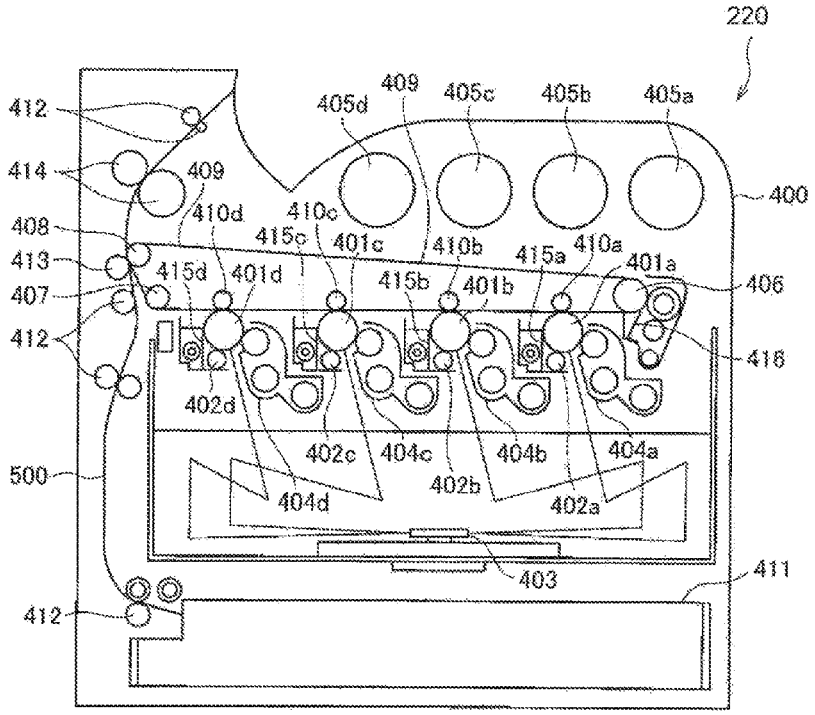
FIG. 5 is a view of a schematic configuration showing an example of still another image forming apparatus according to still another exemplary embodiment.

FIG. 5 is a view of a schematic configuration showing a tandem type or intermediate transfer type image forming apparatus in which four image forming units are arranged side by side as the image forming apparatus according to the exemplary embodiment.

An image forming apparatus 220 includes, in a housing 400, four image forming units corresponding to respective color toner, an exposure device 403 that has a laser light source, an intermediate transfer belt 409, a secondary transfer roll 413, a fixing device 414, and a cleaning device that has a cleaning blade 416.

Since the four image forming units have the same configuration, the configuration of the image forming unit including a photoreceptor 401*a* is described as a representative thereof.

A charging roll 402*a*, a developing device 404*a*, a primary transfer roll 410*a*, and a cleaning blade 415*a* are arranged around the photoreceptor 401*a* in this order in a rotating direction of the photoreceptor 401*a*. The primary transfer roll 410*a* is pressed to the photoreceptor 401*a* with the intermediate transfer belt 409 interposed therebetween. Toner contained in a toner cartridge 405*a* is supplied to the developing device 404*a*.

The charging roll 402*a* is the contact charging type charging device that contacts with the front surface of the photoreceptor 401*a* and charges the front surface of the photoreceptor 401*a*. Only the DC voltage is applied or the voltage obtained by superimposing the AC voltage to the DC voltage is applied to the charging roll 402*a* from a power supply.

The intermediate transfer belt 409 is tensioned by a driving roll 406, a tension roll 407, and a rear roll 408, and travels by rotation of the rolls.

The secondary transfer roll 413 is disposed to be pressed to the rear roll 408 with the intermediate transfer belt 409 interposed therebetween.

The fixing device 414 is, for example, a heating-fixing device that includes a heating roll and a pressure roll.

The cleaning blade 416 is a member that removes toner remaining on the intermediate transfer belt 409. The cleaning blade 416 is disposed downstream of the rear roll 408 and removes the toner remaining on the intermediate transfer belt 409 after the transfer.

A tray 411 that accommodates the recording medium 500 is provided in the housing 400. The recording medium 500 in the tray 411 is transported by a transport roll 412 to a contact portion between the intermediate transfer belt 409 and the secondary transfer roll 413, is further transported to the fixing device 414, and an image is formed on the recording medium 500. The image-formed recording medium 500 is discharged to the outside of the housing 400.

Figure 6:
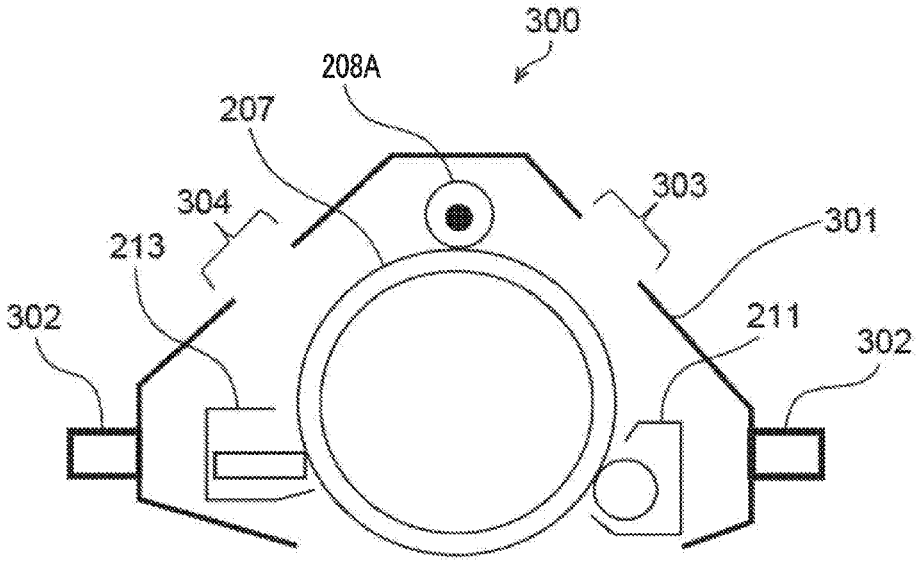
FIG. 6 is a view of a schematic configuration showing an example of a process cartridge according to an exemplary embodiment.

FIG. 6 is a view schematically showing an example of the process cartridge according to the exemplary embodiment. A process cartridge 300 shown in FIG. 6 is attached to and detached from a main body of the image forming apparatus including, for example, the exposure device, the transfer device, and the fixing device.

In the process cartridge 300, the photoreceptor 207, the charging device 208A, the developing device 211, and the cleaning device 213 are integrated by a housing 301. In the housing 301, an attachment rail 302 for attaching and detaching the process cartridge to and from the image forming apparatus, an opening 303 for exposure, and an opening 304 for neutralization exposure are provided.

The charging device 208A that is included in the process cartridge 300 is the contact charging type charging device that is formed by a roll-shaped charging member, that contacts with the front surface of the photoreceptor 207, and that charges the front surface of the photoreceptor 207. When the process cartridge 300 is mounted on the image forming apparatus and an image is formed, only the DC voltage is applied or the voltage obtained by superimposing the AC voltage to the DC voltage is applied to the charging device 208A from the power supply.

Developer and Toner

There is no particular limitation to the developer that is applied in the image forming apparatus according to the exemplary embodiment. The developer may be one-component developer containing only the toner, or may be two-component developer obtained by mixing toner and carrier.

There is no particular limitation to the toner contained in the developer. The toner contains, for example, a binder resin, a colorant, and a releasing agent. Examples of the binder resin of the toner include polyester and styrene acrylic resin.

An external additive may be externally added to the toner. An example of the external additive of the toner is inorganic particulates such as silica, titanium, or alumina.

Toner particles are produced, then, the external additive is externally added to the toner particles, and thereby the toner is prepared. Examples of a method of producing the toner particles include a kneading and grinding method, an aggregation coalescence method, a suspension polymerization method, a dissolution suspension method, and the like. The toner particles may be toner particles having a single-layer structure, or may be toner particles having a so-called core and shell structure which is configured with a core (core particles) and a coating layer (shell layer) that coats the core.

The volume average particle size (D50v) of the toner particles is preferably from 2 μm to 10 μm and more preferably from 4 μm to 8 μm.

There is no particular limitation to the carrier contained in the two-component developer. Examples of the carrier include, for example, coated carrier obtained by coating a resin on a front surface of a core formed of magnetic powder; magnetic powder dispersed-type carrier obtained by dispersing and mixing magnetic powder in a matrix resin; and resin impregnated-type carrier obtained by impregnating a resin in porous magnetic powder.

A mixing ratio (ratio by weight) of the toner and carrier in the two-component developer is preferably that toner: carrier is 1:100 to 30:100, and more preferably 3:100 to 20:100.

EXAMPLE

Hereinafter, the exemplary embodiment of the invention is described in detail with Example; however, the exemplary embodiment of the invention is not limited to the Example at all. In the following description, "parts" and "%" are units based on weight unless noted otherwise.

Preparation of Charging Roll

Example 1

—Forming of Conductive Elastic Layer—

An adhesive (epichlorohydrin-ethylene oxide-allyl glycidyl ether copolymer rubber) is applied on an outer circumferential surface of a shaft which is formed of SUM23L having a diameter of 8 mm and is subjected to hexavalent chromium acid treatment after electroless nickel plating, and then an adhesive layer having a thickness of 5 μm is formed. A composition obtained by kneading the following materials by a 2.5 L kneader and the shaft having the adhesive layer are extruded from an extruder (set at a die temperature of 90° C.) including a cross head die, a layer of the composition is formed on the outer circumferential surface of the shaft, and then the layer is heated at 160° C. for 70 minutes by using air heating furnace, thereby obtaining a conductive elastic layer roll (having an average diameter of 12 mm).

Epichlorohydrin-ethylene oxide-allyl glycidyl ether copolymer rubber (HYDRIN T3106 by Zeon Chemicals L.P)

100 parts

Carbon black (#3030B by Mitsubishi Chemical Corporation)

5 parts

Ion conductive agent (benzyltrimethylammonium chloride, BTEAC by Lion Specialty Chemicals Co., Ltd.) 1 part Vulcanizing agent: 4,4'-dithiodimorpholine (VALNOC R by Ouchi Shinko Chemical Industrial Co., Ltd.) 1.5 parts Vulcanization accelerator: di-2-benzothiazolyl disulfide (NOCCELER DM-P by Ouchi Shinko Chemical Industrial Co., Ltd.)

1.5 parts

Vulcanization accelerator: tetraethylthiuram disulfide (NOCCELER TET-G by Ouchi Shinko Chemical Industrial Co., Ltd.)

1.8 parts

Vulcanization accelerator aid: zinc oxide (Seido Chemical Industry Co., Ltd.) 3 parts Vulcanization accelerator aid: stearic acid 1 part Heavy calcium carbonate 40 parts —Forming of Front Surface Layer—

A dispersion liquid obtained by mixing the following materials, being diluted with methanol, and being subjected to dispersion processing in a bead mill is applied on the outer circumferential surface of the conductive elastic layer roll by dip applying, and then is heated at 160° C. for 30 minutes, and thereby a charging roll having a front surface layer with an average layer thickness of 10 μm is obtained.

N-methoxymethylnylon (F30K by Nagase ChemteX Corporation)

100 parts

Polyvinyl butyral resin (S-LEC BL-1 by Sekisui Chemical Co., Ltd.) 10 parts

Tin oxide (S-2000 with an average particle diameter of 15 nm by Mitsubishi Materials Corporation) 70 parts Polyamide particles (Orgasol 2001 DNat1 with an average particle diameter of 5 μm by Arkema Group) 3 parts Catalyst (NACURE 4167 by Kusumoto Chemical Industry Co., Ltd.)

1 part

Methanol 700 parts

Butanol 200 parts

Examples 2 to 8

The charging roll is obtained in the same way as in Example 1 except that conditions of forming the conductive elastic layer and composition of the front surface layer forming compositions are changed as shown in Table 1.

Example 9

The charging roll is obtained in the same way as in Example 1 except that, after the conductive elastic layer roll with a mean diameter of 15 mm is formed, the mean diameter is reduced to 12 mm by polishing, and composition of the front surface layer forming compositions is changed as shown in Table 1.

Comparative Example 1

The charging roll is obtained in the same way as in Example 1 except that the conductive elastic layer is formed by using the same compositions but the conductive elastic layer is prepared by injection molding using a mold.

Comparative Examples 2 to 4

The charging roll is obtained in the same way as in Example 1 except that conditions of forming the conductive elastic layer and composition of the front surface layer forming compositions are changed as shown in Table 1. In Comparative Example 2, polyamide particles are changed to the following material.

Polyamide particles (Orgasol 2002 EXDNat1 with an average particle diameter of 10 μm by Arkema Group)

Evaluation

Front Surface Shape of Outer Circumferential Surface

The surface texture of the outer circumferential surface of the charging roll is measured using a confocal laser microscope (VK-8500 with an objective lens magnification of 20 by Keyence Corporation) in conditions of a measurement cycle of 0.05 μm in the X and Y directions, a measurement range of 490 μm by 690 μm in the X and Y directions, and a measurement range of 50 μm in the Z direction. The measurement data is subjected to surface correction with the curvature of the charging roll and noise correction. In a case where, of nine measurement points (three points in the X direction by three points in the Y direction), one point having a specifically high or low value (more than 300% or less than 20% of a median value of the other eight points) is detected, the noise correction is performed by allocating the median value of the other eight points to the specific point. The half-value width of the maximum frequency value of the height distribution, the average height of the roughness components, and the average height of the waviness components are obtained from the corrected data.

Micro-Chromatic line

In a modified apparatus of DocuCentre-IV C2260 which includes the contact charging type charging device that applies only the DC voltage to the charging roll, the charging roll of each of Examples and Comparative Examples is incorporated, and a halftone image having image density of 30% on an entire surface is printed on 5,000 sheets of A4 paper under an high-temperature and high-humidity environment (28° C. and 85% RH). The last printed image on the paper is visually observed and classification is performed as follows. G0 and G1 are within a range of permission.

G0: No micro-chromatic line is recognized.

G1: One to three micro-chromatic lines are produced.

G2: Four to ten micro-chromatic lines are produced.

G3: 11 to 20 micro-chromatic lines are produced.

G4: 21 micro-chromatic lines or more are produced.

White Spot

In a modified apparatus of DocuCentre-IV C2260 which includes the contact charging type charging device that applies, to the charging roll, the voltage obtained by superimposing the AC voltage to the DC voltage, the charging roll of each of Examples and Comparative Examples is incorporated, and a halftone image having image density of 60% on an entire surface is printed on a sheet of A3 paper under a low-temperature and low-humidity environment (10° C. and 15% RH). The printed image is visually observed and classification is performed as follows. G0 and G1 are within a range of permission.

G0: No white spot is recognized.

G1: One to ten white spots are produced.

G2: 11 to 25 white spots are produced.

G3: 26 to 50 white spots are produced.

G4: 51 white spots or more are produced.

TABLE 1

| | Conductive Elastic Layer | | | | Front Surface Layer | | |
|---|---|---|---|---|---|---|---|
| | Molding Method | Die Temperature | Vulcanization Condition Temperature | Vulcanization Condition Time | Conductive Agent Type | Conductive Agent Amount | Amount of Polyamide Particles |
| Example 1 | Extrusion Molding | 90° C. | 160° C. | 70 minutes | Tin Oxide | 70 parts | 3 parts |
| Example 2 | Extrusion Molding | 85° C. | 160° C. | 70 minutes | Tin Oxide | 70 parts | 3 parts |
| Example 3 | Extrusion Molding | 90° C. | 160° C. | 70 minutes | Tin Oxide | 70 parts | 6 parts |
| Example 4 | Extrusion Molding | 80° C. | 155° C. | 60 minutes | Tin Oxide | 70 parts | 3 parts |
| Example 5 | Extrusion Molding | 85° C. | 160° C. | 70 minutes | Tin Oxide | 70 parts | 6 parts |
| Example 6 | Extrusion Molding | 85° C. | 155° C. | 60 minutes | Tin Oxide | 70 parts | 10 parts |
| Example 7 | Extrusion Molding | 85° C. | 160° C. | 70 minutes | Tin Oxide | 70 parts | 10 parts |
| Example 8 | Extrusion Molding | 90° C. | 160° C. | 70 minutes | Carbon Black | 15 parts | 6 parts |
| Example 9 | Extrusion Molding + Polishing | 90° C. | 160° C. | 70 minutes | Tin Oxide | 70 parts | 6 parts |
| Comparative Example 1 | Extrusion Molding | 165° C. Mold Temperature | 165° C. Vulcanization in Mold | 10 minutes | Tin Oxide | 70 parts | 3 parts |
| Comparative Example 2 | Extrusion Molding | 85° C. | °160° C. | 70 minutes | Tin Oxide | 70 parts | 20 parts |
| Comparative Example 3 | Extrusion Molding | 100° C. | 170° C. | 70 minutes | Tin Oxide | 70 parts | 6 parts |
| Comparative Example 4 | Extrusion Molding | 85° C. | 160° C. | 70 minutes | Tin Oxide | 70 parts | 13 parts |

| | Surface Texture of Outer Circumferential Surface | | | | | Image Quality | |
|---|---|---|---|---|---|---|---|
| | Half-Value Width | Average Height of Roughness Component | Mean Cycle of Roughness Components | Average Height of Waviness Components | Mean Cycle of Waviness Components | Micro-Chromatic Line | White Spot |
| Example 1 | 1.5 μm | 0.8 μm | 16 μm | 5.1 μm | 0.29 mm | G0 | G1 |
| Example 2 | 2.3 μm | 0.8 μm | 18 μm | 6.5 μm | 0.31 mm | G0 | G1 |
| Example 3 | 2.2 μm | 2.5 μm | 12 μm | 5.1 μm | 0.29 mm | G0 | G0 |
| Example 4 | 2.9 μm | 0.8 μm | 16 μm | 9.0 μm | 0.28 mm | G1 | G1 |
| Example 5 | 2.8 μm | 2.5 μm | 18 μm | 6.5 μm | 0.31 mm | G1 | G0 |
| Example 6 | 2.7 μm | 4.0 μm | 8 μm | 8.2 μm | 0.30 mm | G1 | G0 |
| Example 7 | 2.7 μm | 4.0 μm | 8 μm | 6.5 μm | 0.31 mm | G1 | G0 |
| Example 8 | 2.2 μm | 2.5 μm | 11 μm | 5.1 μm | 0.29 mm | G1 | G1 |
| Example 9 | 2.2 μm | 2.5 μm | 12 μm | 5.1 μm | 0.12 mm | G1 | G0 |
| Comparative Example 1 | 0.8 μm | 0.8 μm | 15 μm | 2.2 μm | 0.15 mm | G0 | G2 |
| Comparative Example 2 | 9.6 μm | 8.2 μm | 7 μm | 6.5 μm | 0.31 mm | G3 | G0 |
| Comparative Example 3 | 2.2 μm | 2.5 μm | 12 μm | 2.4 μm | 0.20 mm | G2 | G0 |
| Comparative Example 4 | 2.8 μm | 4.5 μm | 8 μm | 6.5 μm | 0.31 mm | G2 | G0 |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A charging member comprising:

a support member;

a conductive elastic layer disposed on the support member; and a front surface layer disposed on the conductive elastic layer, wherein irregularities with a cycle of shorter than 0.1 mm and irregularities with a cycle of 0.1 mm or longer are distributed on an entirety of an outer circumferential surface of the charging member, and satisfy the following conditions of (1) and (2):

(1) the irregularities with the cycle of shorter than 0.1 mm have an average height of greater than 0 μm and 4 μm or less; and (2) the irregularities with the cycle of 0.1 mm or longer have an average height of from 5 μm to 30 μm, and wherein a half-value width of a maximum frequency value of height distribution on the outer circumferential surface is from 1 μm to 3 μm.

2. The charging member according to claim 1, wherein the irregularities with the cycle of shorter than 0.1 mm have an average height of from 0.5 μm to 3.5 μm.

3. The charging member according to claim 1, wherein the irregularities with the cycle of shorter than 0.1 mm have an average height of from 1.0 μm to 3.0 μm.

4. The charging member according to claim 1, wherein the irregularities with the cycle of 0.1 mm or longer have an average height of from 5 μm to 20 μm.

5. The charging member according to claim 1, wherein the irregularities with the cycle of 0.1 mm or longer have an average height of from 6 μm to 10 μm.

6. The charging member according to claim 1, wherein a mean cycle of the irregularities with the cycle of shorter than 0.1 mm is 5 μm or longer.

7. The charging member according to claim 1, wherein a mean cycle of the irregularities with the cycle of shorter than 0.1 mm is 50 μm or shorter.

8. The charging member according to claim 1, wherein a mean cycle of the irregularities with the cycle of 0.1 mm or longer is 0.15 mm or longer.

9. The charging member according to claim 1, wherein a mean cycle of the irregularities with the cycle of 0.1 mm or longer is 0.45 mm or shorter.

10. The charging member according to claim 1, wherein the front surface layer contains an electronically conductive agent.

11. The charging member according to claim 10, wherein the electronically conductive agent is a metal oxide.

12. A process cartridge that is attached to or is detached from an image forming apparatus, comprising:

an electrophotographic photoreceptor; and a charging device that includes the charging member according to claim 1, that applies, to the charging member, only a DC voltage or a voltage obtained by superimposing an AC voltage to a DC voltage, and that charges a front surface of the electrophotographic photoreceptor by a contact charging method.

13. An image forming apparatus comprising:

an electrophotographic photoreceptor;

a charging device that includes the charging member according to claim 1, that applies, to the charging member, only a DC voltage or a voltage obtained by superimposing an AC voltage to a DC voltage, and that charges a front surface of the electrophotographic photoreceptor by a contact charging method;

a latent image forming device that forms a latent image on the front surface of the charged electrophotographic photoreceptor;

a developing device that develops the latent image formed on the front surface of the electrophotographic photoreceptor, using developer containing toner, and forms a toner image on the front surface of the electrophotographic photoreceptor; and a transfer device that transfers the toner image formed on the front surface of the electrophotographic photoreceptor to a recording medium.

* * * * *